US011047097B2

(12) United States Patent
Carey et al.

(10) Patent No.: US 11,047,097 B2
(45) Date of Patent: Jun. 29, 2021

(54) TEMPORARY FLEXIBLE PAVEMENT MARKER

(71) Applicant: TrafCo Industries, Inc., Eagle Lake, TX (US)

(72) Inventors: Lesley M. Carey, Eagle Lake, TX (US); Lonny E. Daley, Eagle Lake, TX (US)

(73) Assignee: TrafCo Industries, Inc., Eagle Lake, TX (US)

( * ) Notice: Subject to any disclaimer, the term of this patent is extended or adjusted under 35 U.S.C. 154(b) by 0 days.

(21) Appl. No.: 15/650,337

(22) Filed: Jul. 14, 2017

(65) Prior Publication Data

US 2018/0002877 A1 Jan. 4, 2018

Related U.S. Application Data

(63) Continuation of application No. 14/654,278, filed as application No. PCT/US2013/076558 on Dec. 19, 2013, now abandoned.

(Continued)

(51) Int. Cl.
*E01F 9/00* (2016.01)
*E01F 9/524* (2016.01)

(Continued)

(52) U.S. Cl.
CPC ..... *E01F 9/524* (2016.02); *E01F 9/573* (2016.02); *E01F 9/578* (2016.02)

(58) Field of Classification Search
CPC . E01F 9/553; E01F 9/565; E01F 9/573; E01F 9/524; E01F 9/578

(Continued)

(56) References Cited

U.S. PATENT DOCUMENTS 1,676,843 A * 7/1928 Stephens ..... E01F 9/602 404/10
1,766,073 A * 6/1930 Hartzler ..... E01F 9/602 404/10

(Continued)

FOREIGN PATENT DOCUMENTS

CA 2155398 A1 7/1996
EP 989239 A2 3/2000

(Continued)

OTHER PUBLICATIONS

International Search Report and Written Opinion of the International Searching Authority in International Patent Application No. PCT/US2013/076558 dated Apr. 15, 2014 (14 pages).

(Continued)

*Primary Examiner* — Thomas B Will
*Assistant Examiner* — Katherine J Chu
(74) *Attorney, Agent, or Firm* — Pizarro Allen PC

(57) ABSTRACT

A temporary flexible pavement marker comprising a base, a stand and a protective shield wherein at least part of the stand is reflective and the protective shield is configured to prevent materials sprayed down upon the temporary flexible pavement marker from obscuring the reflective part of the stand may be employed in the construction or repair of roads. Since the protective shield prevents asphalt from obscuring the reflective part of the stand during spraying operations there is no need for a technician to remove a protective layer from the markers after a spraying operation.

13 Claims, 3 Drawing Sheets

Related U.S. Application Data

(60) Provisional application No. 61/749,058, filed on Jan. 4, 2013.

(51) Int. Cl.
*E01F 9/565* (2016.01)
*E01F 9/576* (2016.01)

(58) Field of Classification Search
USPC ..... 116/63 P; D10/113.1
See application file for complete search history.

(56) References Cited

U.S. PATENT DOCUMENTS

| | | | | | |
|---|---|---|---|---|---|
| 1,833,124 | A | * | 11/1931 | Rand | E01F 9/602 404/10 |
| 1,928,447 | A | * | 9/1933 | Cornell, Jr. | E01F 9/578 404/12 |
| 3,784,279 | A | * | 1/1974 | Hedgewick | E01F 9/553 359/531 |
| 4,237,191 | A | * | 12/1980 | Horne | E01F 9/553 359/551 |
| 4,445,803 | A | | 5/1984 | Dixon | |
| 4,462,711 | A | | 7/1984 | Garner | |
| 4,521,129 | A | | 6/1985 | Krech et al. | |
| 4,991,994 | A | | 2/1991 | Edouart | |
| 5,460,115 | A | | 10/1995 | Speer et al. | |
| 6,505,994 | B1 | * | 1/2003 | Attar | E01F 13/022 404/16 |
| D471,125 | S | * | 3/2003 | Farley | D10/113.1 |
| 6,764,249 | B2 | | 7/2004 | Stone | |
| 7,690,861 | B1 | | 4/2010 | Johnson | |
| 7,866,914 | B2 | | 1/2011 | Kulp et al. | |
| 8,342,700 | B2 | | 1/2013 | Naik et al. | |
| D860,845 | S | * | 9/2019 | Carey | D10/113.1 |
| 2003/0194270 | A1 | | 10/2003 | Forrer | |
| 2004/0114997 | A1 | | 6/2004 | Stone | |
| 2011/0293367 | A1 | | 12/2011 | Yeghiayan et al. | |
| 2012/0092767 | A1 | | 4/2012 | Naik et al. | |
| 2013/0108362 | A1 | | 5/2013 | Philip | |

FOREIGN PATENT DOCUMENTS

| | | | |
|---|---|---|---|
| EP | 2337824 | A1 | 6/2011 |
| WO | 2010036522 | A1 | 4/2010 |

OTHER PUBLICATIONS

Notice of References in U.S. Appl. No. 14/654,278 dated Sep. 23, 2016 (1 page).

* cited by examiner

TEMPORARY FLEXIBLE PAVEMENT MARKER

CROSS-REFERENCE TO RELATED APPLICATION

This application is a Continuation of U.S. Non-Provisional patent application Ser. No. 14/654,278 entitled "Temporary Flexible Pavement Markers" filed Jun. 19, 2015, which is a '371 national stage entry of International Patent Application No. PCT/US2013/076558 entitled "Temporary Flexible Pavement Markers" filed Dec. 19, 2013, which claims priority to U.S. Provisional Patent Application 61/749,058 entitled "Temporary Flexible Pavement Markers" filed Jan. 4, 2013, the disclosures of which are wholly incorporated herein by reference.

FIELD

The application relates to pavement markers. The application particularly relates to temporary flexible pavement markers.

BACKGROUND

During the course of highway construction and repair, it is sometimes necessary to route traffic over streets that are incomplete or undergoing reconstruction. During such operations, it is not unusual for accidents to occur in work zones where the edges of the traffic lanes are not clearly marked. This is especially true in the construction of new roads between the time that a subsurface is laid down and the final application of asphalt.

Even after asphalt is applied to a road surface, is not unusual for there to be a period of time between the application of the asphalt and the installation of permanent lane markers. One solution to this problem is the use of temporary pavement markers. It would be desirable in the art of highway construction and maintenance to be able to employ temporary flexible pavement markers that may be installed in a single step.

SUMMARY

In one aspect, the invention is a temporary flexible pavement marker comprising a base, a stand and a protective shield wherein at least part of the stand is reflective and the protective shield is configured to prevent materials sprayed down upon the temporary flexible pavement marker from obscuring the reflective part of the stand.

In another aspect, the invention is a method of constructing or repairing a road comprising using a temporary flexible pavement marker to delineate traffic lanes wherein the temporary pavement marker comprises a base, a stand and a protective shield and wherein at least part of the stand is reflective and the protective shield is configured to prevent materials sprayed down upon the temporary flexible pavement markers from obscuring the reflective part of the stand.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE INVENTION

Figure 1:
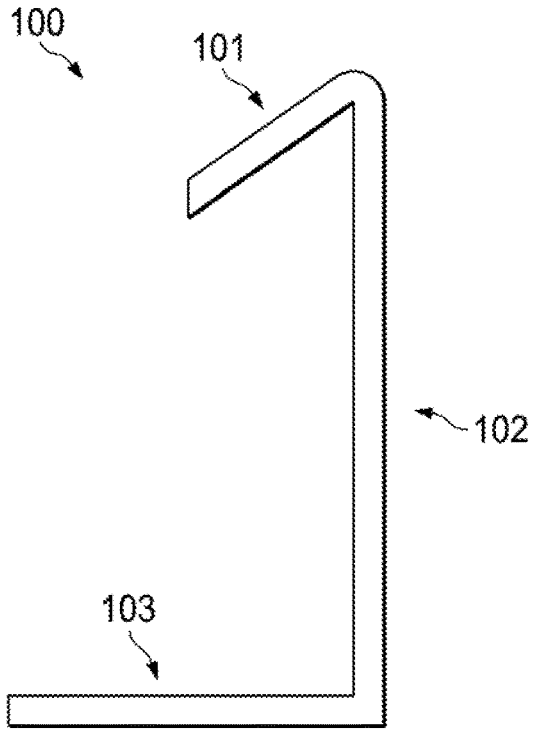
FIG. 1 is a side view illustration of a first embodiment of a temporary flexible pavement marker having an "L" base and a protective shield configured to protect the front side of the temporary flexible pavement marker.

In one embodiment, the invention is a temporary flexible pavement marker comprising a base, a stand and a protective shield wherein at least part of the stand is reflective (either of itself or because of having a reflective tape attached thereto or a reflective paint applied thereof) and the protective shield is configured to prevent materials sprayed down upon the temporary flexible pavement marker from obscuring the reflective part of the stand. Turning to FIG. 1, a first exemplary configuration of a temporary flexible pavement marker 100 is illustrated in a side view showing a protective shield 101, a stand 102 and a base 103. In this configuration, the base is in an "L" configuration.

Figure 2:
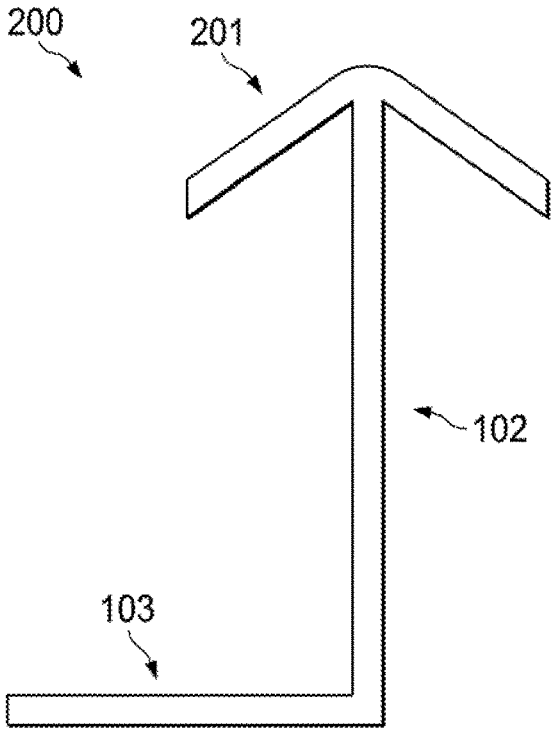
FIG. 2 is a side view illustration of a second embodiment of a temporary flexible pavement marker similar to FIG. 1 except the protective shield is configured to protect both the front and back of the temporary flexible pavement marker.

In FIG. 2, a second exemplary configuration is shown wherein the temporary flexible pavement marker 200 is substantially similar to the configuration in FIG. 1 except that the protective shield 201 is configured to protect both sides of the temporary flexible pavement marker.

Figure 3:
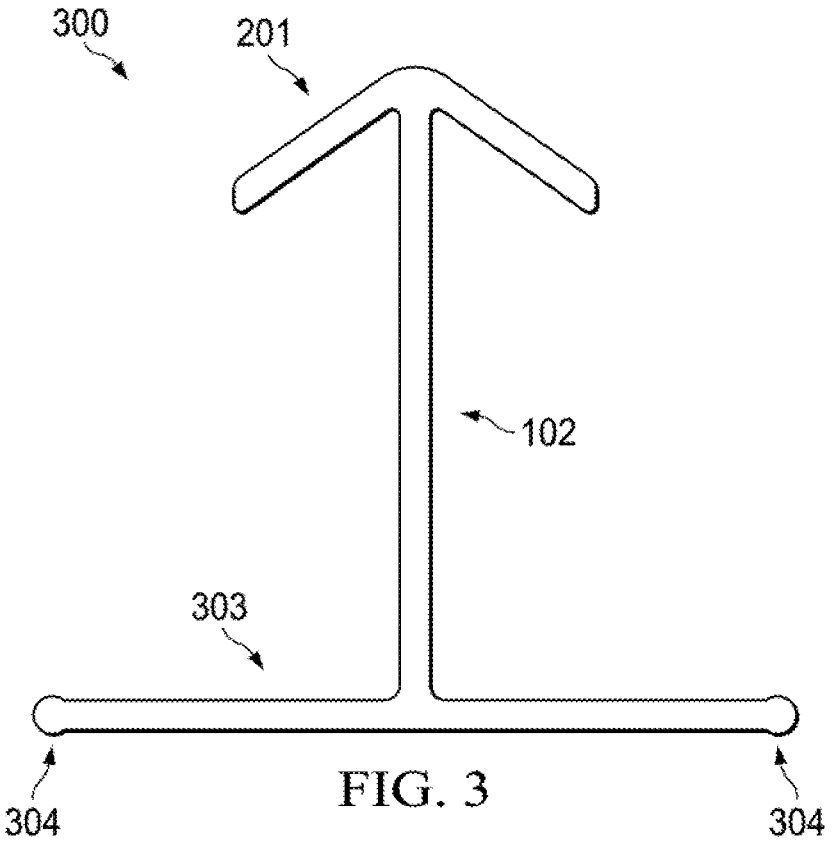
FIG. 3 is a side view illustration of a third embodiment of a temporary flexible pavement marker similar to that of FIG. 2 except that this embodiment has a "T" base which also is equipped with ridges along the edge of the base.

In FIG. 3, a third exemplary configuration a temporary flexible pavement marker 300 is shown which is substantially similar to that illustrated in FIG. 2 except that the base 303 is extended into an inverted "T." Additionally the edges of the base have been modified into a ridge 304. In some end uses of the temporary flexible pavement markers of the application, it may be desirable to retain a fluid such as tar or asphalt in order to improve the adhesion of the temporary flexible pavement marker to the pavement. The presence of ridges serves to facilitate the retention of fluid.

Figure 4:
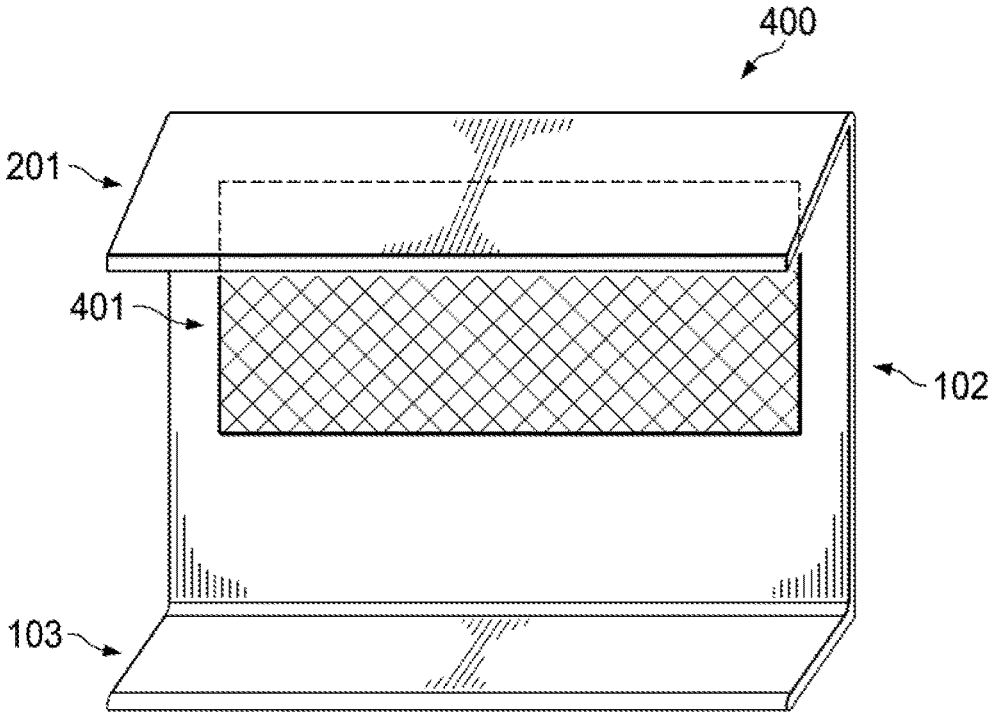
FIG. 4 is a frontal view illustration of the embodiment illustrated in FIG. 1 additionally showing a reflective surface.

FIG. 4 is a frontal view of the temporary marker 400 illustrated in FIG. 1. Note that a reflective surface 401 is also illustrated in this figure.

Figure 5:
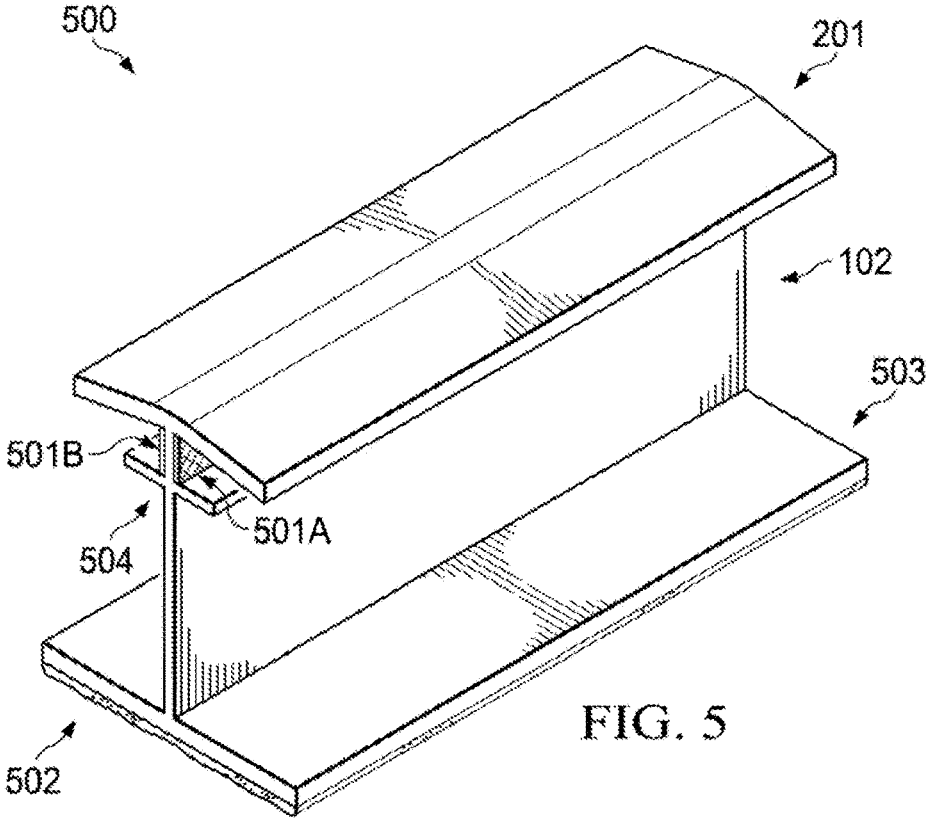
FIG. 5 is an isometric view of an additional embodiment which is configured for one way traffic with an alternative configuration for two-way traffic also shown.

In yet another embodiment, a temporary pavement marker 500 is shown in FIG. 5. In this embodiment, the protective shield 201 is similar to that of FIG. 2. The stand 102 is as described above in FIG. 1, except that it has been modified to include a secondary protective rib 504 to prevent back splashing from the surface of the road. The protective rib 504 may extend a protective rib width 506 from the stand 102. Also illustrated is an adhesive layer 502 applied to the base 503.

Figure 6:
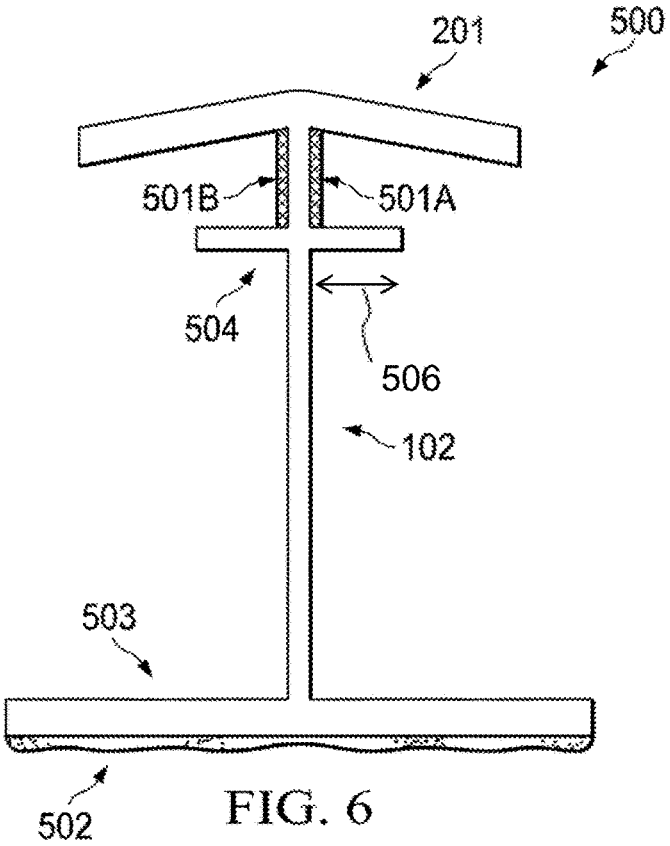
FIG. 6 is a side view of the embodiment illustrated in FIG. 5.

FIG. 6 is a side view of the temporary flexible pavement marker illustrated in FIG. 5. In this view, it can be seen that there are two reflective elements (501A and 501B) on the stand between the protective shield and secondary rib. As illustrated, this embodiment having reflective elements on both sides would be typical of those used for two-way traffic. In an alternative embodiment, reflective element 501B would not be present and the resulting temporary flexible pavement marker having a reflective element on one side would be typical of those markers used for one way traffic.

The temporary flexible pavement markers of the application may be prepared using any material known to be useful to those of ordinary skill in the art of making such items. For example, they may be prepared using plastics and/or metal. When the markers are made of plastic, the plastic used maybe one selected from the group consisting of: polyethylene, polypropylene, polyurethane, polyvinyl chloride, copolymers of polyethylene and polypropylene, and combinations thereof. Other plastics may also be used. Useful metals include, but are not limited to, aluminum, spring steel, and the like. In some embodiments, the markers may be prepared using composites of metal and plastics.

In one embodiment, the point of intersection of the base and the stand is a living hinge. In another embodiment, the entire stand is flexible. No matter what material is used to construct the temporary flexible pavement markers, the markers are configured such that when they are run over by an automobile, the material will rebound substantially to its original configuration so that the reflective surface will be visible to drivers.

The dimensions of the temporary flexible pavement markers of the application may be any that are useful for delineating traffic lanes. In some embodiments, the markers are 4 inches wide and 2 inches high. In these embodiments, a base in the "L" configuration may be from 1 to 2 inches wide while a base in a "T" configuration may be from 1.5 to 4 inches wide. In many venues, the governmental entity having responsibility for the maintenance and construction of highways may have a specification regarding such dimensions.

The stand of the temporary flexible pavement markers is at least partially reflective. In some embodiments, the reflective portion of the stand is prepared by applying thereto a reflective tape or a reflective paint. In other embodiments, the stand itself is reflective. For the purposes of this application the term "reflective" means that the subject surface is either retro reflective or prismatic to the extent that the temporary flexible pavement markers are sufficiently responsive to automobile headlights to safely delineate a traffic lane at night or other dark driving conditions.

The temporary flexible pavement markers of the application have a protective shield. The purpose of this protective shield is to prevent or at least mitigate fluids such as asphalt or tar from obscuring the reflective surface of the stand during spraying. Such spraying occurs both in initial construction and in repairing roads.

During the repair or construction of a road, a subsurface is first prepared. Often asphalt is applied and then gravel is spread upon the road subsurface and fixed in place by the asphalt. In one embodiment of the method of the application, a temporary flexible pavement marker is placed upon the subsurface, next a spray of asphalt is applied and then gravel is spread on the road partially or fully covering the base of the temporary marker.

The asphalt spraying procedure is comparatively slow which results in the asphalt being sprayed nearly straight down. All of the figures show that the protective shield is angled down. That is, the protective shield is angled downwards towards the ground when the base of the temporary flexible pavement marker is positioned on a road surface. In an alternative embodiment (not shown), the orientation of the protective shield may be perpendicular to the stand. The width of the protective shield for a four inch by 2-inch temporary pavement marker, may be from ½ to 1 inch. These dimensions may be scaled for temporary flexible pavement markers having different overall dimensions.

The temporary flexible pavement markers of the application may be configured to be reflective on one side or two sides. The markers reflective on one side would be useful for one way traffic while the markers being reflective on both sides could be used for two-way traffic. It is also within the scope of the application that the markers be color coded in accordance with local ordinances to indicate one way or two-way traffic. For example, for one way traffic, the marker could be white and for two-way traffic, yellow.

The temporary flexible pavement markers of the application represent a substantial improvement over the prior art. Prior art markers included protective layers that had to be removed after a spraying operation. In such situations, a technician was required to bend down or bend over to remove the protective layer from each marker. Since the number of markers employed in such operations may range from 500 to several thousand per mile, the cost for this was not insignificant.

In addition to the elements are described, the temporary flexible pavement markers of the application may be prepared with any additional element known to be useful to those of ordinary skill in the art of making such objects. For example, in one embodiment, the temporary flexible pavement markers may have an adhesive applied to the bottom of the base. In most applications, the adhesive is a tacky adhesive and the protected from getting dirty by use of a paper or plastic tape.

What is claimed is:

1. A temporary flexible pavement marker comprising:

a base configured for mounting to a road surface;

a stand flexibly extending substantially perpendicularly from the base, the stand comprising a substantially planar surface, the stand having a planar reflective portion, and a planar non-reflective portion extending from the base to the reflective portion; and a protective shield including a bottom surface, the protective shield extending a protective shield width from the end of the stand, said bottom surface angled downwards towards the ground when said base is mounted on said road surface, the protective shield being configured to substantially shield the reflective portion from fluid road treatment material when the fluid road treatment material is sprayed down from above the protective shield toward the road surface or base.

2. The temporary flexible pavement marker of claim 1, wherein the stand and base form either an "L" or an inverted "T".

3. The temporary flexible pavement marker of claim 1 wherein the temporary flexible pavement marker comprises plastic.

4. The temporary flexible pavement marker of claim 3 wherein the plastic is selected from the group consisting of polyethylene, polypropylene, polyurethane, polyvinyl chloride, copolymers of polyethylene and polypropylene, and combinations thereof.

5. The temporary pavement marker of claim 1 wherein the temporary pavement marker comprises metal.

6. The temporary flexible pavement marker of claim 5 wherein the metal is selected from the group consisting of aluminum, spring steel, and combinations thereof.

7. A temporary flexible pavement marker comprising:

a base configured for mounting to a road surface;

a stand flexibly extending substantially perpendicularly from the base, the stand having a reflective portion;

a protective shield including a bottom surface, the protective shield extending a protective shield width from the end of the stand, said bottom surface angled downwards towards the ground when said base is mounted on said road surface, the protective shield being configured to substantially shield the reflective portion from being obscured by fluid material sprayed down from above the protective shield toward the road surface or base;

a protective rib extending a protective rib width from the stand below the reflective portion, the protective rib width being shorter than the protective shield width, and the protective rib being configured to substantially shield the reflective portion from spray backsplash of the fluid material from the road surface or base.

8. The temporary flexible pavement marker of claim 7 further comprising an adhesive affixed to the base so as to permit adhesive mounting of the base to the road surface.

9. The temporary flexible pavement marker of claim 7, the reflective portion comprising reflective tape.

10. The temporary flexible pavement marker of claim 7, the reflective portion comprising reflective paint.

11. The temporary flexible pavement marker of claim 7, said bottom surface angled downwards to form an acute angle with said stand.

12. A method of constructing or repairing a road comprising affixing a temporary flexible pavement marker to the road to delineate traffic lanes wherein the temporary pavement marker comprises a base configured for mounting to a road surface, a stand flexibly extending substantially perpendicularly from the base, and a protective shield, the protective shield including a bottom surface and extending a protective shield width from the end of the stand, the bottom surface angled downwards towards the ground when said base is mounted on a road surface, and wherein at least part of the stand is reflective and the protective shield is configured to prevent materials sprayed down upon the temporary flexible pavement markers from obscuring the reflective part of the stand.

13. The method of claim 12 wherein the temporary flexible pavement marker is first applied to a newly constructed or repaired pavement surface, then a layer of asphalt applied thereto followed by the application of gravel.

* * * * *